US005319823A

United States Patent [19]

Baum et al.

[11] Patent Number: 5,319,823

[45] Date of Patent: Jun. 14, 1994

[54] CONDUCTOR CLEANING BRUSH WITH MANUALLY GRASPABLE HANDLE ADAPTED FOR MOUNTING ON SHOTGUN STICK

[75] Inventors: Larry R. Baum, Hastings Township, Barry County; David F. Hamilton, Baltimore Township, Barry County; John Sawka, Hastings Township, Barry County; John Carpenter, Hope Township, Barry County, all of Mich.

[73] Assignee: Hastings Fiber Glass Products, Inc., Hasting, Mich.

[21] Appl. No.: 963,918

[22] Filed: Oct. 20, 1992

[51] Int. Cl.[5] ..... A46B 3/18

[52] U.S. Cl. ..... 15/160; 15/143.1; 15/145; 15/176.3; 15/202; 15/206

[58] Field of Search ..... 15/106, 143.1, 144.1, 15/145, 159.1, 160, 166, 146, 172, 176.1, 176.3, 176.5, 176.6, 194, 202, 206; 403/322, 353, 360

[56] References Cited

U.S. PATENT DOCUMENTS

| | | | |
|---|---|---|---|
| D. 110,185 | 6/1938 | Lukenbill | 15/143.1 |
| 832,498 | 10/1906 | McHenry | 15/206 |
| 1,188,779 | 6/1916 | Hodge | 15/206 |
| 1,444,416 | 2/1923 | Doty | 15/144.1 |
| 1,477,468 | 12/1923 | Wansor | 15/176.6 |
| 1,576,182 | 3/1926 | Fletcher | 15/206 |
| 2,172,479 | 9/1939 | McMillen | 15/160 |
| 2,175,278 | 10/1939 | Orebaugh | 15/172 |
| 2,185,867 | 1/1940 | Pensky | 15/145 |
| 2,348,972 | 5/1944 | Gray | 15/172 |
| 2,507,881 | 5/1950 | Bennett | 15/143.1 |
| 2,668,971 | 2/1954 | Bagley, Jr. | 15/206 |
| 2,752,625 | 7/1956 | Ponsell | 15/143.1 |
| 2,817,867 | 12/1957 | Bugbird | 15/160 |
| 4,056,863 | 11/1977 | Gunjian | 15/206 |
| 4,922,575 | 5/1990 | Riemann | 15/143.1 |

FOREIGN PATENT DOCUMENTS

| | | | |
|---|---|---|---|
| 726340 | 1/1966 | Canada | 15/143.1 |
| 601559 | 8/1934 | Fed. Rep. of Germany | 15/160 |
| 2844832 | 4/1980 | Fed. Rep. of Germany | 15/206 |
| 379748 | 11/1907 | France | 15/206 |
| 806597 | 12/1958 | United Kingdom | 15/172 |
| 1418462 | 12/1975 | United Kingdom | 15/160 |

*Primary Examiner*—Philip R. Coe
*Assistant Examiner*—Mark Spisich
*Attorney, Agent, or Firm*—Flynn, Thiel, Boutell & Tanis

[57] ABSTRACT

A conductor cleaning brush has a handle which is a single integral plastic part, the handle including a grippable center section having at opposite ends a mounting section and a brush supporting section. The mounting section includes a portion of noncircular cross section which extends into and mates with an opening of noncircular cross section in a shotgun stick. Two brush parts each have a cylindrical bristle arrangement, and have a stem which is fixedly secured in the brush mounting section of the handle. The brush parts diverge with respect to each other in a direction away from the handle, the ends of the bristle arrangements nearest the handle having radially overlapping bristles and the opposite ends of the bristle arrangements being spaced.

16 Claims, 2 Drawing Sheets

CONDUCTOR CLEANING BRUSH WITH MANUALLY GRASPABLE HANDLE ADAPTED FOR MOUNTING ON SHOTGUN STICK

FIELD OF THE INVENTION

This invention relates to a brush and, more particularly, to a brush for cleaning conductors of a power transmission system.

BACKGROUND OF THE INVENTION

A metal conductor of a power transmission system often needs cleaning before a test device or other equipment is connected to it, in order to ensure good electrical contact between the conductor and the equipment. For this purpose, a conductor cleaning brush is typically used, which includes two cylindrical wire brush parts positioned adjacent each other and at a slight angle to each other, so that adjacent bristles at one end overlap and adjacent bristles at the opposite end are spaced, thereby creating a V-shaped channel into which the electrical conductor can be inserted. With the conductor in the channel, the brush is moved reciprocally along a portion of the conductor to clean dirt, oxidation and the like from the conductor.

In one conventional brush of this type, the brush parts are each mounted on a short handle which can be manually gripped, the handle having at an end opposite from the brush parts an eye which can be used to hang the brush for storage when it is not in use. This brush is entirely satisfactory when the electrical conductor is within easy reach and the degree of electrical insulation is of minimal concern. However, in other circumstances, for example where the electrical conductor is suspended a number of feet above the ground, a person standing on the ground cannot reach the conductor with the brush because of the very short handle of the brush. Alternatively, specific utility work rules or a need for increased electrical insulation may make an insulating extension handle necessary. This conventional brush has no provision for being attached to any type of extension handle.

Instead, a different type of brush adapted only for use with an extension handle is provided. This brush also has the two brush parts, but they are supported on a mounting part which also has half of a connector commonly referred to as a universal connector. An elongate conventional pole made of an insulating material such as fiberglass has at one end the other half of the connector, and is commonly referred to as a universal stick. The connector parts on the brush and stick have aligned openings through which a bolt extends, and have facing surfaces which are perpendicular to the bolt and which each have a ring of serrations thereon, the serrations preventing relative rotation of the connector parts when the bolt is tightened. However, this second type of brush cannot be conveniently manually grasped for purposes of cleaning a conductor when it is detached from the universal stick. Consequently, it is presently common for a person servicing power transmission lines to purchase and carry one brush of each type.

Instead of the universal stick mentioned above, some persons servicing power transmission systems carry a different insulating stick which is commonly referred to as a "shotgun stick" and which has a different type of connector structure at one end thereof. One conventional shotgun stick is disclosed in U.S. Pat. No. 3,788,691. The connecting structure at the end of this shotgun stick is illustrated in FIGS. 5 and 6 of the present application, and is described in detail later. The first type of brush described above cannot be used with a shotgun stick, and in order to permit use of the second "universal" type of brush with the shotgun stick, .a special small adapter is used. This adapter has half of a universal connector of the type mentioned above, and also has a conventional mounting arrangement which can be gripped by tne shotgun stick. This adapter represents yet another component which must be purchased and carried by a person who has a shotgun stick rather than a universal stick. In particular, in order to handle most conductor-cleaning tasks encountered during day-to-day job responsibilities, a person using a shotgun stick rather than a universal stick normally must carry a manual brush of the first type, a universal brush of the second type, and a universal-shotgun adapter.

It is therefore an object of the present invention to provide an improved conductor cleaning brush which is a single unit and can be used either manually or with a shotgun stick, without any need for additional brushes or adapters.

SUMMARY OF THE INVENTION

The objects and purposes of the invention, including those set forth above, are met according to one form of the present invention by providing a conductor cleaning brush which includes: an elongate handle having a gripping section which can be manually grasped, having a brush supporting section and having a mounting section, the mounting section having a centerline which extends in a first direction, having an opening extending transversely therethrough in a second direction substantially perpendicular to the first direction, and having four angularly spaced ribs which project radially outwardly with respect to the centerline and which are disposed between the opening and the gripping section, the mounting section and the ribs being integral with the gripping section. Two brush parts each have an elongate stem and a plurality bristles which project radially from the stem. Each stem has at one end a mounting portion which is free of bristles, the mounting portions of the stems being fixedly secured in the brush supporting section so that the stems diverge at a small acute angle in a direction away from the brush supporting section.

A different form of the present invention relates to the combination of an elongate shotgun stick and a conductor cleaning brush removably mounted on the shotgun stick, the shotgun stick having an opening of noncircular cross section extending lengthwise thereinto from one end thereof, and having a hook assembly supported within the opening for movement lengthwise of the shotgun stick between first and second positions in which a hook of the hook assembly is respectively disposed within and spaced outwardly from the end of the shotgun stick. The conductor cleaning brush includes a handle having a brush supporting section, a mounting section, and a gripping section adapted to be manually grasped, the mounting section being integral with the gripping section and including a first portion which has a transverse opening therethrough and a second portion which is disposed between the first portion and the gripping section and which has a noncircular cross section approximately congruent to the noncircular section of the opening in the shotgun stick. The mounting section is disposed substantially within the opening of the shotgun stick at the end of the shotgun stick, the hook assembly being in the first position and the hook thereof extending through the transverse opening in the mounting section.

BRIEF DESCRIPTION OF THE DRAWINGS

A preferred embodiment of the invention is described in detail hereinafter with reference to the accompanying drawings, in which.

DETAILED DESCRIPTION

Figure 2:
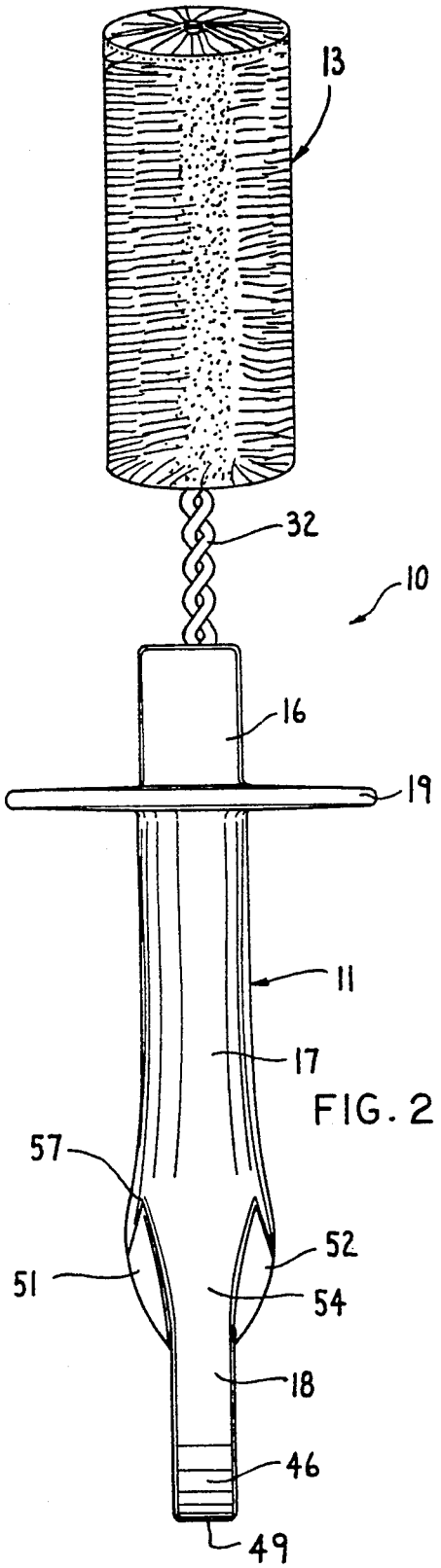
FIG. 2 is an elevational side view of the brush of FIG. 1.

In FIGS. 1–4, a conductor cleaning brush which embodies the invention is designated generally by reference numeral 10, and includes an elongate handle 11 and two brush parts 12 and 13.

The handle 11 includes a brush supporting section 16, a center section 17 which can be manually gripped, a mounting section 18 which can be releasably coupled to a shotgun stick in a manner described later, and a disc 19 which is perpendicular to a centerline 21 of the handle 11 and which is disposed between the brush supporting section 16 and center section 17. The handle 11 is a single integral component made by thermoplastic injection molding techniques.

The brush supporting section 16 of the handle is approximately rectangular in shape, and two bores 26 and 27 extend into the brush supporting section 16 from an axial end of the handle 11 at a acute angle to each other, the centerline 21 of the handle bisecting the angle between the bores 26 and 27. A threaded blind hole 28 extends into the brush supporting section 16 perpendicular to the centerline 21 so as to extend between and intersect a peripheral portion of each of the bores 26 and 27. The threaded hole 28 receives a screw stud 29.

Each of the brush parts 12 and 13 has a rectilinear stem 31 or 32 formed by a pair of twisted metal wires, the upper portion of each stem carrying a cylindrical bristle arrangement 33 or 34 formed by a plurality of stainless steel bristles which are gripped between the twisted wires of the stem and project radially outwardly from the stem in various directions. The lower ends of the bristle arrangements 33 and 34 are sufficiently close to each other so that the outer ends of their bristles overlap, whereas the upper ends of the bristle arrangements 33 and 34 are spaced, thereby defining a V-shaped channel 36 between the bristle arrangements 33 and 34. Each of the stems 31 and 32 has a lower portion 38 or 39 which is free of bristles, and which extends into a respective one of the bores 26 and 27 in the brush supporting section 16 of the handle 11. During assembly, the lower stem portions 38 and 39 are inserted into the bores 26 and 27, and then the screw stud 29 is screwed into the threaded hole 28, the screw stud 29 engaging the stems of both brushes and wedging these stem within their respective bores 26 and 27 so that these stems cannot be withdrawn and are fixedly supported by the brush supporting section 16.

The center section 17 of the handle 11 has a circular cross section throughout its length, the upper half of the center section 16 having a radius which is approximately constant along its length, and the lower half of the center section 17 having a radius which increases progressively in a direction toward the mounting section 18. The disc 19 at the upper end of the center section 17 has a radius which, in the preferred embodiment, is 3 to 4 times the radius of the upper end of the center section 17.

The mounting section 18 includes a platelike portion 46 which extends downwardly from the lower end of the center section 17 and has an approximately rectangular cross section, the width of the platelike portion 46 being approximately equal to the diameter of the center section 17 at the lower end of section 17, and the thickness of the platelike portion 46 being approximately one-third of its width. The platelike portion 46 has a circular opening 48 extending transversely through its lower end in a direction perpendicular to the centerline 21 of the handle. An arcuate surface 49 is provided at the lower end of the platelike portion 46, and is substantially concentric to the opening 48.

A pair of ribs 51 and 52 extend lengthwise of the handle 11 and project radially outwardly from opposite sides of the platelike portion 46. As evident from FIG. 2, the ribs 51 and 52 each have at their upper end a radial dimension approximately equal to the radius of the lower end of the center section 17, and each tapers in radial dimension in a direction downwardly along the handle, until they merge with the side surfaces of the platelike portion 46 a small distance above the opening 48. The edge portions of the upper end of the platelike portion 46 serve as a further pair of ribs 53 and 54, which are each offset by 90° from the ribs 51 and 52 of the first pair, and which each extend lengthwise of the handle. Thus, as best seen in FIG. 3, the mounting section 18 has in the region of the ribs 51–54 a cross section which has approximately the shape of a cross.

Figure 3:
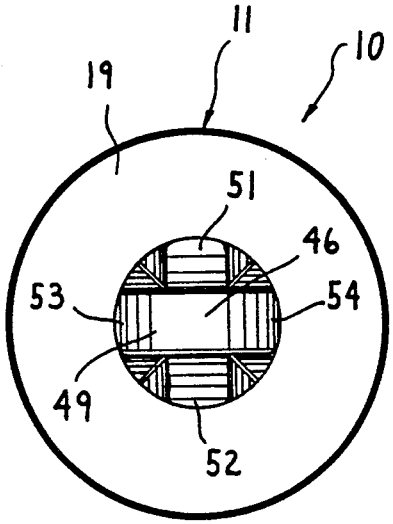
FIG. 3 is a bottom view of the brush of FIG. 1.

As shown in FIG. 2, the platelike portion 46 increases progressively in thickness at its uppermost end, and thus the portions thereof which serve as the ribs 53 and 54 also progressively increase in transverse thickness in an upward direction. Similarly, the ribs 51 and 52 increase in transverse thickness in an upward direction. Each rib thus merges with the angularly adjacent ribs at the lower end of center section 17. For example, as shown in FIG. 1, rib 51 merges with ribs 53 and 54 at points 56 and 57, which are at the lower end of center section 17.

Figure 5:
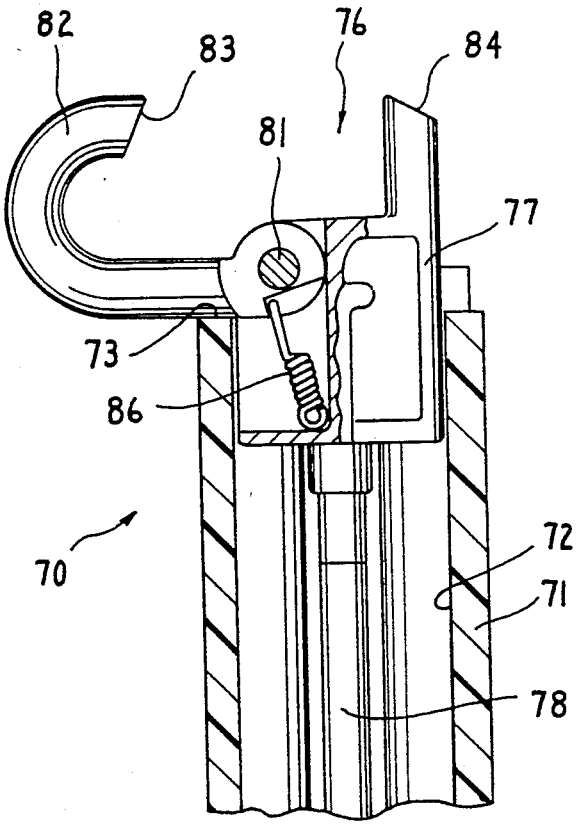
FIG. 5 PRIOR ART
FIG. 5 is a fragmentary sectional side view of part of a conventional shotgun stick on which the brush of FIGS. 1–4 can be removably mounted.
Figure 6:
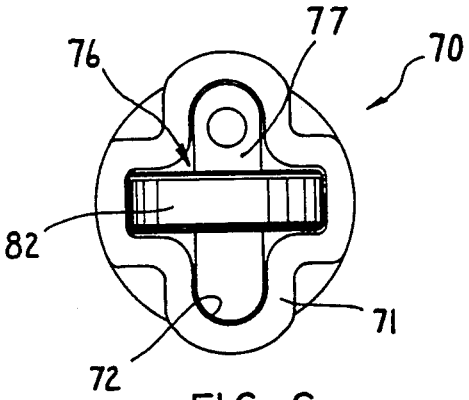
FIG. 6 PRIOR ART
FIG. 6 is a top view of the shotgun stick of FIG. 5, with a hook thereof in a different operational position.

FIGS. 5 and 6 show an end of a conventional device which is commonly referred to as a "shotgun stick" and which can optionally be used to support the conductor cleaning brush of FIGS. 1–4 during operational use. A suitable conventional shotgun stick is disclosed in detail in McMullin U.S. Pat. No. 3,788,691, the disclosure of which is hereby incorporated herein by reference. Since the shotgun stick 70 is conventional, it is described only briefly herein, to the extent necessary to facilitate an understanding of the present invention.

More specifically, the shotgun stick 70 includes an elongate body 71 which is made of an insulating material such as fiberglass, and which has an elongate opening with a cross-shaped cross section extending into it in a lengthwise direction from an end surface 73 of the body 71. A hook assembly 76 includes a support member 77 which also has a cross-shaped cross section and which is supported within the opening 72 for vertical movement between an upper position shown in FIG. 5 and a not-illustrated lower position. An elongate rod 78, which is also preferably made of an insulating material such as fiberglass, can be reciprocally moved in a lengthwise manner within the opening 72 by a not-illustrated handle arrangement at the lower end of the shotgun stick 70, the upper end of the rod 78 being fixedly secured to the support member 77 so that the support member 77 is moved between its operational positions by vertical movement of the rod 78. The support member 77 includes a transversely extending pin 81, which pivotally supports a hook 82 for movement from an open position (FIG. 5) through 90° in a clockwise direction to a closed position (FIG. 6) in which the surfaces 83 and 84 are in engagement. A spring 86 urges pivotal movement of the hook 82 in a counterclockwise direction in FIG. 5.

Figure 1:
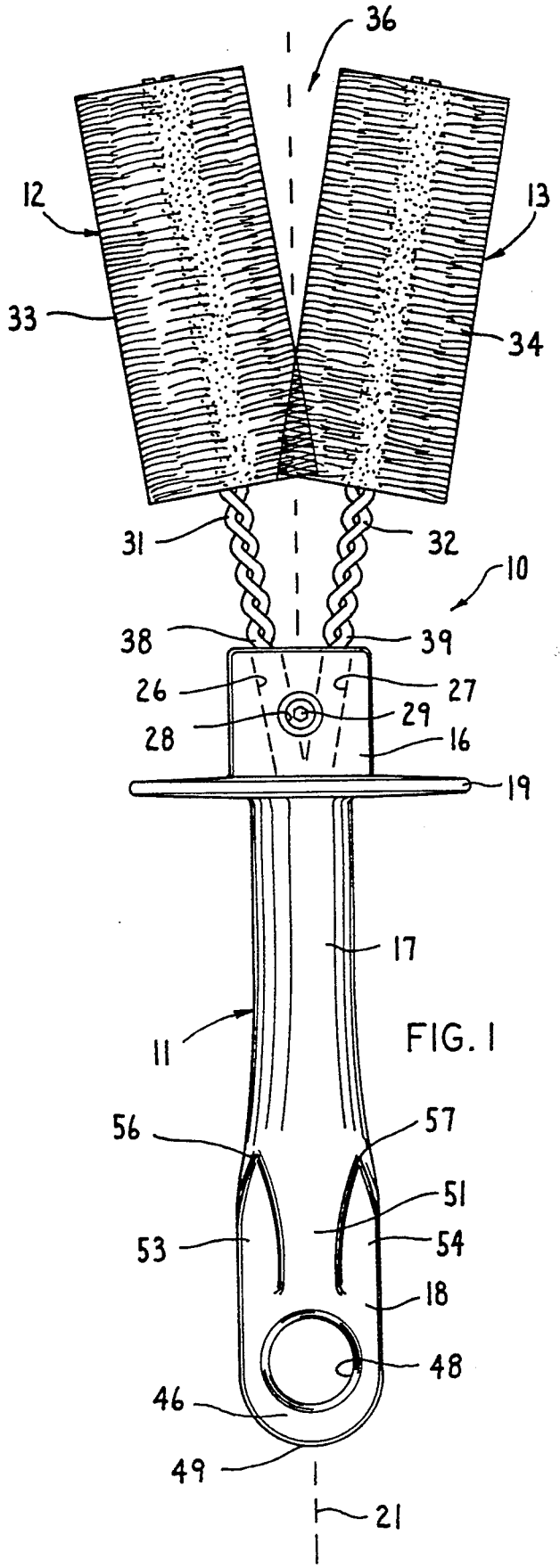
FIG. 1 is an elevational front view of a conductor cleaning brush which embodies the present invention.
Figure 4:
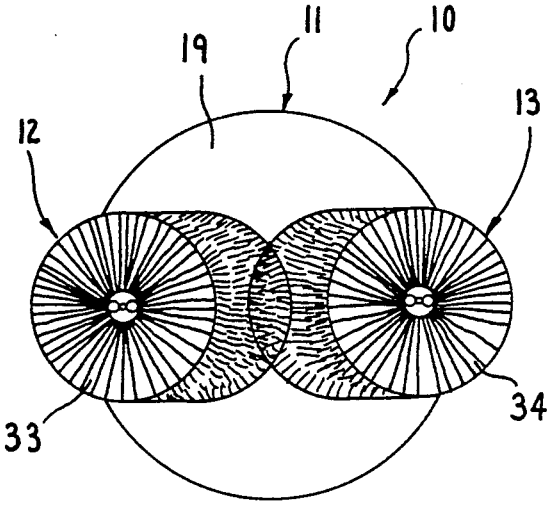
FIG. 4 is a top view of the brush of FIG. 1.

Viewed from the back, the brush 10 is a mirror image of FIG. 1, except that the opening 28 and stud 29 are not visible. Similarly, the side of the brush opposite from that shown in FIG. 2 is a mirror image of FIG. 2.

OPERATION

The conductor cleaning brush of FIGS. 1–4 can be used to clean electrical conductors of a power transmission system in two different ways. First, with the brush 10 completely disconnected from any shotgun stick, the center portion 17 can be manually grasped and the brush can be manually positioned so that an elongate electrical conductor (not illustrated) is disposed within the V-shaped channel 36 between the brush parts 12 and 13 and extends perpendicular to the plane of FIG. 1. Then the brush is manually moved lengthwise of the conductor in a reciprocal manner while pressing the brush toward the conductor so that the conductor is urged into the apex of the V-shaped channel 36.

Alternatively, instead of being directly manually held, the brush can be mounted on a shotgun stick of the type shown in FIGS. 5 and 6. In this regard, the not-illustrated handle of the shotgun stick is manipulated in a conventional manner to move the rod 78 and support member 77 upwardly to the position of FIG. 5, in which the spring 86 pivots the hook 82 counterclockwise to the position shown in FIG. 5. The end 83 of the hook 82 is then inserted through the transverse opening 48 in the mounting section 18 of the handle 11. Then, the rod 78 and support member 77 of the shotgun stick are pulled downwardly, the end surface 73 of the shotgun stick pivoting the hook 90° clockwise from the position of FIG. 5 against the urging of the spring 86 until the surfaces 83 and 84 are adjacent. The support member 77 and hook 82 move downwardly into the body 71 of the shotgun stick, and pull the lower end of the mounting portion 18 downwardly into the opening 72 in the shotgun stick. The ribs 51–54 on the brush 10 move into the upper end of the opening 72 in the shotgun stick, the cross-shaped cross section of the opening in mounting section 18, in the region of ribs 51–54, cooperating with the cross-shaped cross section of the upper end of the opening 72 to prevent rotation of the brush 10 relative to the shotgun stick. The ribs 51–54 move into the opening 72 until the progressively increasing widths of the ribs are greater than the widths of the corresponding portions of the opening 72 and the ribs become firmly wedged within the opening 72, so that there is virtually no play or wobble between the brush 10 and shotgun stick 70. Then, the shotgun stick is manually gripped at the end remote from the brush 10 and manipulated so that the brush 10 engages and cleans an electrical conductor in a manner similar to that already described above. Afterward, the brush 10 can be detached from the shotgun stick by carrying out in reverse order the above-described sequence of events used to attached the brush to the shotgun stick.

Although one preferred embodiment has been described in detail for illustrative purposes, it will be recognized that there are variations or modifications of the disclosed embodiment, including the rearrangement of parts, which lie within the scope of the present invention.

The embodiments of the invention in which an exclusive property or privilege is claimed are defined as follows:

1. A conductor cleaning brush comprising: a handle having a gripping section which can be manually grasped, having a brush supporting section provided on said gripping section, and having a mounting section provided on said gripping section, wherein said mounting section has a centerline which extends in a first direction, has an opening extending transversely therethrough in a second direction substantially perpendicular to said first direction, and has a plurality of angularly spaced ribs which project radially outwardly with respect to said centerline and which are disposed between said opening and said gripping section, said gripping section being disposed between said mounting section and said brush supporting section; and two brush parts each having an elongate stem and a plurality of bristles which project radially outwardly in respective directions from said stem, each said stem having at one end a mounting portion which is free of said bristles, said mounting portions of said stems each being fixedly secured in said brush supporting section so that said stems diverge at a small acute angle in a direction away from said brush supporting section; wherein said ribs each having a thickness in a circumferential direction which increases progressively in a direction toward said gripping section.

2. A brush according to claim 1, wherein said gripping section is elongate and extends approximately in said first direction, wherein said mounting section and said brush supporting section are provided at opposite ends of said gripping section, wherein said mounting section of said handle includes a platelike portion which extends outwardly from said gripping section approximately perpendicular to said second direction, said platelike portion having a substantially uniform width in a third direction perpendicular to said first and second directions and having said transverse opening therethrough, wherein a first pair of said ribs which are offset by 180° with respect to each other are defined by respective edge portions of said platelike portion, and wherein a second pair of said ribs each offset by 90° from said ribs of said first pair project outwardly from said platelike portion in opposite directions which are parallel to said second direction.

3. A brush according to claim 2, wherein said ribs of said second pair taper progressively in radial height in a direction toward said transverse opening.

4. A brush according to claim 1, wherein said gripping section is elongate, extends substantially in said first direction, and has a substantially circular cross section throughout its length, said substantially circular cross section increasing progressively in diameter from a middle portion thereof to an end of said gripping section adjacent said mounting section, said ribs each having at an end thereof adjacent said gripping section a radial dimension which is substantially equal to the radial dimension of said gripping section adjacent said mounting section.

5. A conductor cleaning brush comprising: a handle having a gripping section which can be manually grasped, having a brush supporting section provided on said gripping section, and having a mounting section provided on said gripping section, wherein said mounting section has a centerline which extends in a first direction, has an opening extending transversely therethrough in a second direction substantially perpendicular to said first direction, and has four angularly spaced ribs which project radially outwardly with respect to said centerline and which are disposed between said opening and said gripping section, said mounting section and said ribs being integral with said gripping section; and two brush parts each having an elongate stem and a plurality of bristles which project radially outwardly in respective directions from said stem, each said stem having at one end a mounting portion which is free of said bristles, said mounting portions of said stems each being fixedly secured in said brush supporting section so that said stems diverge at a small acute angle in a direction away from said brush supporting section; wherein said gripping section is elongate and extends approximately in said first direction; wherein said mounting section and said brush supporting section are provided at opposite ends of said gripping section; wherein said mounting section of said handle includes a platelike portion which extends outwardly from said gripping section approximately perpendicular to said second direction, said platelike portion having a substantially uniform width in a third direction perpendicular to said first and second directions and having said transverse opening therethrough; wherein a first pair of said ribs which are offset by 180° with respect to each other are defined by respective edge portions of said platelike portion, and a second pair of said ribs each offset by 90° from said ribs of said first pair project outwardly from said platelike portion in opposite directions which are parallel to said second direction; said ribs of said second pair tapering progressively in radial height in a direction toward said transverse opening; and wherein said platelike portion and said ribs of said first pair each have a dimension parallel to said second direction which increases progressively in thickness in a direction toward said gripping section, and said ribs of said second pair have a dimension parallel to said third direction which increases in thickness in a direction toward said gripping section.

6. A brush according to claim 5, wherein an end of said platelike portion remote from said gripping section has an arcuate surface which is approximately concentric to a centerline of said transverse opening.

7. A brush according to claim 5, wherein said gripping section has a substantially circular cross section throughout its length, said substantially circular cross section increasing progressively in diameter from a middle portion thereof to an end of said gripping section adjacent said mounting section, said ribs each having at an end thereof adjacent said gripping section a radial dimension which is substantially equal to the radial dimension of said gripping section adjacent said mounting section.

8. A brush according to claim 7, including between said gripping section and said brush supporting section a disc section which extends substantially perpendicular to said first direction and which has a radius substantially greater than the radius of an end of said gripping section adjacent said disc section..

9. A brush according to claim 8, wherein said handle is made from a single piece of molded plastic, said gripping section, said brush supporting section, said mounting section and said disc section being respective integral portions of said plastic handle.

10. A brush according to claim 9, wherein said mounting section has first and second bores which each receive said end portion of said stem of a respective said brush part, and has a threaded opening extending between said bores approximately perpendicular thereto so as to intersect each said bore, and including a screw stud disposed in said threaded opening and engaging said end portions of said stems of said brushes so as to resist withdrawal of said stems from said bores.

11. An apparatus comprising in combination:

an elongate shotgun stick having an opening which extends lengthwise thereinto from one end thereof and which includes a plurality of angularly spaced lengthwise recess portions, and having a hook assembly supported within said opening for movement lengthwise of said shotgun stick between first and second positions in which a hook of said hook assembly is respectively disposed within and spaced outwardly from said end of said shotgun stick; and a conductor cleaning brush removably mounted on said shotgun stick, said brush including a handle having a brush supporting section, a mounting section, and a gripping section adapted to be manually grasped, said mounting section including a first portion which has a transverse opening therethrough and a second portion which is disposed between said first portion and said gripping section and which has a plurality of angularly spaced and outwardly projecting ribs each having a transverse thickness which increases progressively in a direction toward said gripping section, said mounting section being disposed substantially within said opening at said end of said shotgun stick so that each said rib is disposed in a respective said recess portion, said hook assembly being in said first position and said hook thereof extending through said transverse opening in said mounting section.

12. A brush according to claim 11, wherein said gripping section is elongate and extends approximately in a first direction, wherein said transverse opening extends through said mounting section in a second direction substantially perpendicular to said first direction, wherein said mounting section and said brush supporting section are provided at opposite ends of said gripping section, wherein said mounting section of said handle includes a platelike portion which extends outwardly from said gripping section approximately perpendicular to said second direction, said platelike portion having a substantially uniform width in a third direction perpendicular to said first and second directions, wherein a first pair of said ribs which are offset by 180° with respect to each other are defined by respective edge portions of said platelike portion, and wherein a second pair of said ribs each offset by 90° from said ribs of said first pair project outwardly from said platelike portion in opposite directions which are parallel to said second direction.

13. A brush according to claim 12, wherein said ribs of said second pair taper progressively in radial height in a direction toward said transverse opening.

14. A conductor cleaning brush comprising: a handle having a gripping section which can be manually grasped, having a brush supporting section provided on said gripping section, and having a mounting section provided on said gripping section, wherein said mounting section has a centerline which extends in a first direction, has an opening extending transversely therethrough in a second direction substantially perpendicular to said first direction, and has a plurality of angularly spaced ribs which project radially outwardly with respect to said centerline and which are disposed between said opening and said gripping section; and two brush parts each having an elongate stem and a plurality of bristles which project radially outwardly in respective directions from said stem, each said stem having at one end a mounting portion which is free of said bristles, said mounting portions of said stems each being fixedly secured in said brush supporting section so that said stems diverge at a small acute angle in a direction away from said brush supporting section; wherein said gripping section is elongate, extends substantially in said first direction between said mounting section and said brush supporting section, and has a substantially circular cross section throughout its length, said substantially circular cross section increasing progressively in diameter from a middle portion thereof to an end of said gripping section adjacent said mounting section, said ribs each having at an end thereof adjacent said gripping section a radial dimension which is substantially equal to the radial dimension of said gripping section adjacent said mounting section.

15. A brush according to claim 14, wherein said mounting section and said brush supporting section are provided at opposite ends of said gripping section, wherein said mounting section of said handle includes a platelike portion which extends outwardly from said gripping section approximately perpendicular to said second direction, said platelike portion having a substantially uniform width in a third direction perpendicular to said first and second directions and having said transverse opening therethrough, wherein a first pair of said ribs which are offset by 180° with respect to each other are defined by respective edge portions of said platelike portion, and wherein a second pair of said ribs each offset by 90° from said ribs of said first pair project outwardly from said platelike portion in opposite directions which are parallel to said second direction.

16. A brush according to claim 14, wherein said ribs of said second pair taper progressively in radial height in a direction toward said transverse opening.

* * * * *